United States Patent [19]

McDougall

[11] 4,341,331

[45] Jul. 27, 1982

[54] ARTICLE HOLDER

[76] Inventor: Patrick P. McDougall, 6305 Mt. Ainsworth, San Diego, Calif. 92111

[21] Appl. No.: 286,797

[22] Filed: Jul. 27, 1981

[51] Int. Cl.[3] ..... A45F 5/00

[52] U.S. Cl. ..... 224/219; 224/222; 224/229; 224/901

[58] Field of Search ..... 224/219, 222, 229, 267, 224/901, 221, 224, 228, 236

[56] References Cited

U.S. PATENT DOCUMENTS

| | | | |
|---|---|---|---|
| D. 29,490 | 10/1898 | Varni-Gardinier | 224/229 X |
| 3,543,977 | 12/1970 | Lockridge | 224/901 X |
| 4,024,999 | 5/1977 | Latham | 224/222 |
| 4,139,133 | 2/1979 | Repka | 224/901 X |

*Primary Examiner*—Steven M. Pollard

*Attorney, Agent, or Firm*—Charmasson, Branscomb & Holz

[57] ABSTRACT

An article holder, being specifically tailored to the needs of surfers and the like for containing a key and strapping same to the wrist or ankle, utilizes a pair of mating strips of Velcro laid out side-by-side with proximal end portions overlapping, with a nylon fabric rectangular backing panel stitched behind the overlapping end portions to define a hinge line between them so they may swing together in engaged relation, the geometry of the situation being such that when engaged, the distal ends of the strips will also engage when wrapped around a wrist or the like. A pocket structure is defined behind one of the end portions of one Velcro strip in two of the embodiments illustrated and claimed.

8 Claims, 7 Drawing Figures

ARTICLE HOLDER

BACKGROUND OF THE INVENTION

Bathers, swimmers, and particularly surfers who drive to the beach frequently lock all of their valuables in their car. Naturally, the only item of value that it is not practical to lock in the car is the key. Although some bathing suits and some wetsuits have provision for holding a key, many don't, and those that do exist are not necessarily secure. The loss of a key can cause considerable inconvenience.

For this reason, many surfers and beachgoers have in the past resorted to hiding the key somewhere on the vehicle, such as over the tire in one of the rear tire wells. However, increasingly there are theives, especially young thieves who may be concealed in the parking lot or adjacent brush waiting for someone to hide the key on the vehicle. Once the hapless driver has entered the water and is out of sight, inasmuch as on large beaches there is a general anonymity and no one knows whose car belongs to whom, the thieves are free to retrieve the key and pilfer the inside of the car, or even the car itself.

There is a need, therefore, for a very simple, inexpensive and absolutely foolproof keyholder that will safely retain a key on the wrist or ankle of a surfer, jogger, swimmer or anyone else not having a pocket.

SUMMARY OF THE INVENTION

The present invention fulfills the above stated need by providing an extremely simple, and yet almost absolutely foolproof, means of strapping a key on the wrist or ankle. By the simple expedient of a pair of mating Velcro straps hinged together at their overlying end portions on a back panel of nylon fabric, the straps may swing into mated relation to capture a key between the faces of the Velcro, with the extended ends of the Velcro engaging one another when wrapped around a wrist. Velcro, generally referred to as "hook-and-loop" fasteners, has shown itself to be an extremely effective fastening means for surfers, and is virtually impervious to the water, sand, and strain involved in surfing. Almost uniformly surfing leashes are attached to the surfer's ankle with Velcro, and many wetsuits use Velcro in one fashion or another.

In the most sophisticated embodiments, the nylon fabric patch which defines the hinge line between the adjacent end portions of the Velcro strips also has a flap panel stitched back against the nylon which defines a pocket. The opening to the pocket is on the inside along the hinge line, so that it is imposible for the key to slip out of the pocket when the two halves are folded together, and it is impossible to unfold the two halves when the Velcro is engaged around the ankle or wrists of the user.

DETAILED DESCRIPTION OF THE PREFERRED EMBODIMENT

Figure 1:
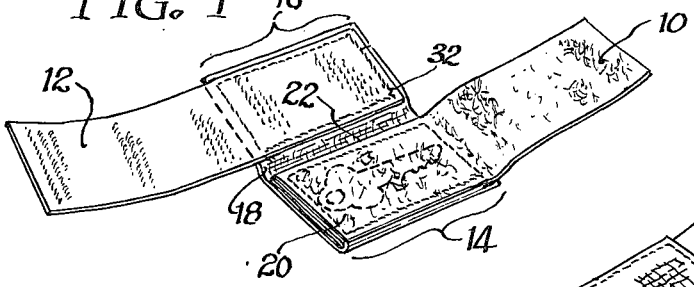
FIG. 1 is a perspective of the main embodiment of the invention.
Figure 2:
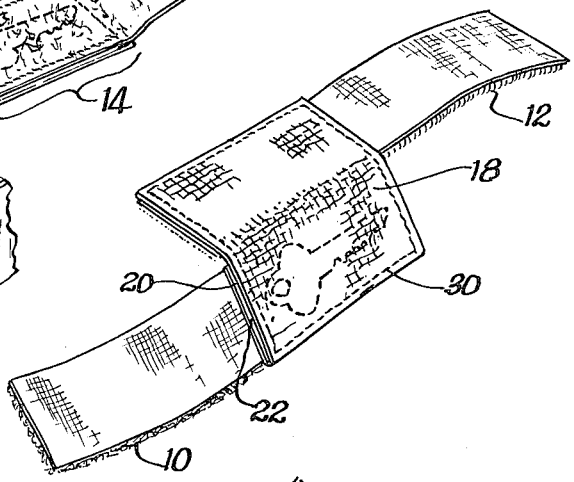
FIG. 2 is a perspective of the invention similar to FIG. 1 but from the opposite viewpoint.

The principal, and most complicated, embodiment of the invention is shown in FIGS. 1 through 5. It consists of two lengths or straps of Velcro material, length 10 being the fuzzy or looped part and length 12 being the hooked part. These mating parts are, of course, interchangeable. As can be seen in FIG. 1, these straps are arranged generally parallel with their proximal ends 14 and 16, respectively, overlapping as both lengths lie face-up.

Figure 3:
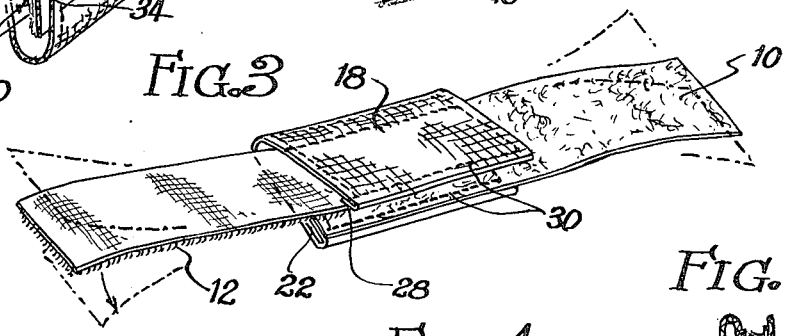
FIG. 3 illustrates the article holder in closed position.
Figure 5:
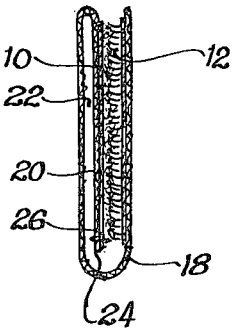
FIG. 5 is a section taken along line 5—5 of FIG. 4.
Figure 4:
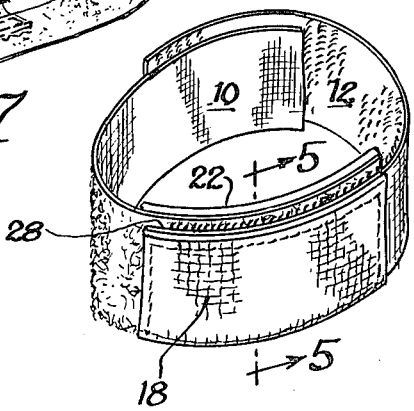
FIG. 4 illustrates the article holder as it appears wrapped around an imaginary wrist.

A panel of nylon fabric or the equivalent is indicated at 18, and in the preferred embodiment this panel also has an extended return flap 20 which defines a pocket 22 between the flap and the panel. The entire periphery of the panel, including the flap, is folded to define a hem 28 which is continuously stitched around the periphery as shown at 30. The leading edge 24 of the flap is stitched to the overlying strip 12 at 26, and then the flap is folded into place with the leading edge adjacent the hinge line, and a second stitching is made along the three sides which define the pocket other than the open, leading edge of the flap. The stitch along line 32, which defines a rectangle, secures strip 12 along the hinge line and the other three sides, which are now doublestitched, so that all of the hem except at the hinge line is double-stitched, making it stronger, stiffer and more resistant to accidental opening. Thus it takes one piece of nylon fabric, two lengths of mating Velcro material, continuous rectangular stitch and a pair of subsequent stitching steps and the article is completed. A key, ring, coin or other small article is easily contained within the pocket 22, and, contrary to any small pockets or purses having a flap opening outwardly, it can be seen that once the Velcro strips have been swung into engagement as shown in FIG. 3 and the Velcro strips wrapped around a wrist as shown in FIG. 4, because the Velcro strip backing material is relatively stiff and definitely inextensible, there is no way that the key can be removed from the pocket, or fall out, until the holder is removed from the wrist of the user.

Figure 6:
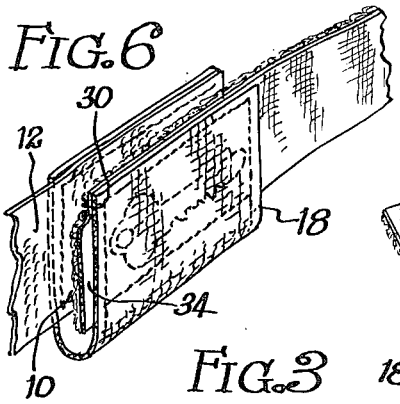
FIG. 6 illustrates a slight modification where there is no nylon return flap, and the Velcro itself defines the pocket cover.

Although the device as described above is very effective, two modifications require note. They are both simpler in construction, the first shown at FIG. 6, being identical to the embodiment illustrated in FIGS. 1 through 5, except that it lacks the flap 20. Instead, a pocket 34 is defind by the Velcro strip 10 itself, so that a folding operation and one of the line stitches may be omitted.

Figure 7:
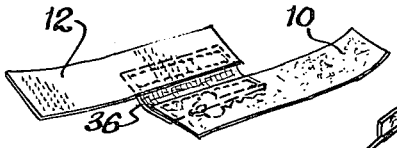
FIG. 7 illustrates yet another modification wherein there is no pocket, but merely a hinge defined for the Velcro.

In FIG. 7 a further simplification is effected by utilizing for the hinge material a small swatch of nylon 36, which does no more than hinge the two Velcro halves together. The Velcro will itself form around the key, and although it would not be as safe as the other embodiments, would have the advantage of being quite inexpensive to make and would still be effective provided the mating Velcro surface area was large compared to the size of the key.

Another modification which deserves mention is the incorporation of two pockets as opposed to one in the unit. This could be done by omitting that portion of the stitching adjacent the hemline in the strap 12, or by the incorporation of whatever reinforcements are desired, perhaps such that the second pocket resembles the construction of the first. The provision of two pockets would give the user a means of keeping a key separate from a coin, for instance, and might also perhaps increase somewhat his carrying capability.

In all the embodiments, an extremely simple and effective article is provided which will be of great benefit to surfers, swimmers, runners and others not having a suitable place to retain their automobile key.

While I have described the preferred embodiment of the invention, other embodiments may be devised and different uses may be achieved without departing from the spirit and scope of the appended claims.

What is claimed is:

1. A hook-and-loop type article holder comprising:

(a) a length of hook material having a hooked face and a fabric back;

(b) a length of loop material having a looped face and a fabric back;

(c) said lengths being arranged parallel, facing substantially the same direction, and with mutually longitudinally overlapping proximal end portions; and (d) a hinge means fastening the adjacent edges of said proximal end portions and defining a hinge line such that said lengths can be rotated about said hinge line into face-to-face hook-and-loop engagement to capture an article therebetween, and the distal ends of said lengths can be wrapped around a member such as a wrist or ankle and engaged in face-to-face hook-and-loop engagement.

2. Structure according to claim 1 wherein said hinge comprises a rectangular fabric panel substantially spanning the combined widths of said end portions.

3. Structure according to claim 2 wherein one of said lengths is fastened along three sides of the portion of said panel, the respective length overlaps, with the edge of said one lengths adjacent the hinge line being open to define, together with said panel, a pocket closed on three sides.

4. Structure according to claim 2 wherein said panel has a cover flap folded back over half of said panel with its leading edge adjacent said hinge line and fastened at its sides to the panel to define a three-sided pocket, with the leading edge being open, and with the proximal end portion of one of said lengths being fastened to said flap with its back against the exposed front of said flap.

5. Structure according to claim 4 wherein said panel and overlying flap define a rectangle, said proximal ends overly said rectangle substantially spanning the respective halves of said rectangle, and including a continuous peripheral stitch around the border of said rectangle and through the overlying portion of said proximal end portions.

6. Structure according to claim 5 and including a stitch line fastening the leading edge of said flap to the overlapping proximal end portion of the respective lengths.

7. Structure according to claim 5 wherein said panel is inwardly folded around its periphery to define a double thickness, reinforced seam.

8. Structure according to claim 1 wherein said lengths are of sufficient length to wrap around the average wrist and engage the distal ends thereof in face-to-face relation when said lengths are fastened to said hinge.

* * * * *